US007570901B2

(12) United States Patent
Choi

(10) Patent No.: US 7,570,901 B2
(45) Date of Patent: Aug. 4, 2009

(54) ROLLER SPACING APPARATUS AND IMAGE FORMING DEVICE HAVING THE SAME

(75) Inventor: Dong-hyuk Choi, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 483 days.

(21) Appl. No.: 11/383,516

(22) Filed: May 16, 2006

(65) Prior Publication Data

US 2007/0053718 A1 Mar. 8, 2007

(30) Foreign Application Priority Data

Sep. 6, 2005 (KR) ..... 10-2005-0082875

(51) Int. Cl.

| | |
|---|---|
| ***G03G 15/00*** | (2006.01) |
| ***G03G 21/16*** | (2006.01) |
| ***G03G 21/18*** | (2006.01) |
| ***G03G 15/02*** | (2006.01) |
| ***G03G 15/04*** | (2006.01) |
| ***G03G 15/06*** | (2006.01) |
| ***G03G 15/08*** | (2006.01) |

(52) U.S. Cl. ..... 399/126; 399/115; 399/116; 399/119; 399/159; 399/222; 399/279

(58) Field of Classification Search ..... 399/111, 399/113, 115–117, 119, 126, 159, 222, 279
See application file for complete search history.

(56) References Cited

U.S. PATENT DOCUMENTS 6,134,395 A * 10/2000 Sasaki et al. ..... 399/46
2002/0071693 A1* 6/2002 Shimaoka ..... 399/113
2005/0185989 A1* 8/2005 Kosuge et al. ..... 399/168

FOREIGN PATENT DOCUMENTS

| | | |
|---|---|---|
| JP | 62-49385 | 3/1987 |
| JP | 2002-328525 | 11/2002 |
| JP | 2004-101671 | 4/2004 |
| KR | 2003-69895 | 8/2003 |

* cited by examiner

*Primary Examiner*—David M Gray
*Assistant Examiner*—Joseph S Wong
(74) *Attorney, Agent, or Firm*—Stanzione & Kim, LLP

(57) ABSTRACT

A roller spacing apparatus and an image forming device including the same. The roller spacing apparatus includes a first roller member that is rotatable, a second roller member that is rotatable in a close contact with the first roller member under a predetermined pressure, and at least one spacing part to space apart the first and the second roller members from each other by a predetermined gap such that the first and the second roller members are not in contact with each other when the first and the second roller members are not in use. The spacing part includes a bushing member that has a bushing to rotatably support a shaft of at least one of the first and the second roller members and a lever disposed at the bushing to rotate the bushing, the bushing having an inner diameter part to support the shaft and an outer diameter part, the inner and outer diameter parts being non-concentric circles, and a stopping member to restrict an operation range of the lever.

24 Claims, 9 Drawing Sheets

ROLLER SPACING APPARATUS AND IMAGE FORMING DEVICE HAVING THE SAME

CROSS-REFERENCE TO RELATED APPLICATIONS

This application claims the benefit under 35 U.S.C. § 119 from Korean Patent Application No. 2005-82875, filed on Sep. 6, 2005, in the Korean Intellectual Property Office, the entire content of which is incorporated herein by reference.

BACKGROUND OF THE INVENTION

1. Field of the Invention

The present general inventive concept relates to an electrophotographic image forming device, such as a laser printer, a digital photocopier, and a facsimile machine. More particularly, the present general inventive concept relates to a roller spacing apparatus to space apart two rollers (e.g., to space apart a photoconductive medium and a developing roller, or to space apart a photoconductive medium and a charging roller) that rotate in close contact with each other under a predetermined pressure and by a predetermined distance, and to maintain the two rollers in a non-contact state, such as when the two rollers are not in use (e.g., during shipping), and an image forming device having the apparatus.

2. Description of the Related Art

Generally, an electrophotographic image forming device, such as a laser printer, a digital photocopier, and a facsimile machine, comprises a photoconductive medium to form a developer image.

A charging roller, a laser scanning unit (LSU), and a developing roller are disposed at predetermined locations around an outer circumference of the photoconductive medium in a rotation direction. The charging roller charges a surface of the photoconductive medium with a predetermined electric potential, the LSU scans the surface of the charged photoconductive medium with laser beams and thereby forms an electrostatic latent image on the surface of the photoconductive medium, and the developing roller supplies a developer to the surface of the photoconductive medium and thereby forms a developer image corresponding to the electrostatic latent image.

The developing roller and the charging roller are rotated in close contact with the photoconductive medium under a predetermined pressure. The photoconductive medium, the developing roller, the charging roller, or each of them comprises an elastic layer, such as a rubber layer, to provide protection from a contact damage.

The image forming device maintains the photoconductive medium and the charging roller and/or the developing roller with the elastic layer in close contact until the image forming device is delivered to a user. As a result, the elastic layer is physically and permanently compression set to prevent high viscosity low molecular organic matter of the elastic layer to chemically-change and thus to come out from a surface of the elastic layer. The high viscosity low molecular organic matter is combined with the developer and adheres to the surface of the photoconductive medium. In this case, physical and chemical changes may cause device components to malfunction and may cause image degradation, deteriorating a reliability of the device. In some cases, a deformed roller, or even the image forming device itself, has to be replaced.

The photoconductive medium, the charging roller, and the developing roller are fabricated in the form of a process cartridge that integrates components into a housing as a single module unit, so that the components are easily detachable from a body of the electrophotographic image forming device for easy repair or replacement.

If the process cartridge fabricated for replacement is not in use, e.g., until it is mounted in the body of the image forming device after coming into market and being purchased by a user), the photoconductive medium and the charging roller and/or the developing roller are in close contact with each other during the period of non-use. Accordingly, there is a problem that the elastic layer of the photoconductive medium, the developing roller, and/or the charging roller may be physically or chemically damaged.

In order to address this problem, the image forming device or the process cartridge comprises an apparatus for spacing apart the charging roller or the developing roller from the photoconductive medium when not in use.

FIGS. 1 to 3 are views illustrating a roller spacing apparatus 1, which spaces apart a developing roller from a photoconductive medium when an image forming device is not in use.

The roller spacing apparatus 1 comprises a spacing member 30 disposed at a shaft 21 of a developing roller 1, and the spacing member 30 is movable between a first position and a second position. If the spacing member 30 is at the first position, the developing roller 20 is not spaced apart from a photoconductive medium 10, as illustrated in FIG. 2. If the spacing member 30 is at the second position, the developing roller 20 is spaced apart from the photoconductive medium 10 by a predetermined gap g, as illustrated in FIG. 3.

The spacing member 30 comprises a spacing protrusion 35 that is brought into contact with a stepped portion 12 of a driving gear 11 of the photoconductive medium when the spacing member 30 is at the second position, and spaces apart the developing roller 20 from the photoconductive medium 10 by the predetermined gap 'g'.

The spacing member 30 is movable between the first and the second positions along a shaft 21 of the developing roller 20 by a spacing member moving part 40.

The spacing member moving part 40 comprises a first rotary member 41 and a second rotary member 42. The first rotary member 41 is idle-rotatable around the shaft 21 and the second rotary member 42 is rotatable integrally with the shaft 21 at a D-cut portion 22 of the shaft 21. The first and the second rotary members 41 and 42 are restricted by fixing members 48 and 47, respectively, so that the first and the second rotary members 41 and 42 do not move in a lengthwise direction of the shaft 21.

As illustrated in FIG. 3, the roller spacing apparatus 1 has a rotary knob 50 into which the D-cur portion 22 of the shaft 21 is inserted to rotate the second rotary member 42. When the shaft 21 is rotated after being inserted into the rotary knob 50, the shaft 21 and the second rotary member 42 are rotated in the same direction. The first rotary member 41 is rotated in relation to a rotational movement of the photoconductive medium 10 when the image forming device operates.

An operation of the conventional roller spacing apparatus 1 as constructed above will now be described.

The rotary knob 50 is rotated in one direction, i.e., in a counter clockwise direction, after being combined with the shaft 21 of the developing roller 20 of an image forming device or a process cartridge, which has passed a printing test of an image quality test.

As the rotary knob 50 is rotated, the second rotary member 42 and the shaft 21 are rotated together with the rotary knob 50 in the counter clockwise direction. At this time, a third rotary projection 45 and a fourth rotary projection 46 of the second rotary member 42 are rotated along a second inclination surface 36 of the spacing member 30, thereby moving the spacing member 30 to the second position of the shaft 21.

As illustrated in FIG. 3, the spacing protrusion 35 of the spacing member 30 is brought into contact with the stepped portion 12 of the driving gear 11 of the photoconductive medium 10 due to the movement of the spacing member 30 such that the developing roller 20 is spaced apart from the photoconductive medium 10 by a distance corresponding to as much as a height of the spacing protrusion 35.

The image forming device or the process cartridge thus comes into market with the developing roller 20 being spaced apart from the photoconductive medium 10. The developing roller 20 and the photoconductive medium 10 remain spaced apart from one another until the image forming device or the process cartridge is delivered to a user.

When the image forming device or the process cartridge performs a printing operation, the first rotary member 41 is rotated in the counter clockwise direction by a driving force transmitted from a main driving device of the image forming device to the first rotary member 41 through the driving gear 11 of the photoconductive medium 10. At this time, a first rotary projection 43 (lockable into a first locking portion 31) and a second rotary projection 44 (lockable into a second locking portion 32) of the first rotary member 41 are rotated along a first inclination surface 37 of the spacing member 30, thereby moving the spacing member 30 from the second position of the shaft 21 to the first position.

The spacing protrusion 35 is removed from the stepped portion 12 of the driving gear 11 of the photoconductive medium 10 by the movement of the spacing member 30, and as a result, the developing roller 20 is brought into contact with the photoconductive medium 10.

During this process, the second rotary member 42 and the developing roller 20 are not rotated because the third and the fourth rotary projections 45 and 46 of the second rotary member 42 are not locked into a third locking portion 33 and a fourth locking portion 34 until the spacing member is rotated by 180°.

After that, when the first rotary member 41 is rotated at least one time, the spacing member 30 is rotated by more than 180°. Accordingly, the third and the fourth rotary projections 45 and 46 of the second rotary member 42 are respectively-locked into the third and the fourth locking projections 33 and 34 of the spacing member 30. As a result, the rotational force of the first rotary member 41 is transmitted to the second rotary member 42, and the developing roller 20 is rotated along with the second rotary member 42 in the counter clockwise direction. That is, the photoconductive medium 10 and the developing roller 20 are rotated in close contact with each other and perform a predetermined developing operation.

When the main driving device of the image forming device stops its driving operation, the first and the second rotary projections 43 and 44 of the first rotary member 41, the third and the fourth rotary projections 45 and 46 of the second rotary member 42, and the spacing protrusion 35 of the spacing member, interacting with the aforementioned elements, maintain a contact state as illustrated in FIG. 2 as long as the user does not forcibly-rotate the shaft 21 of the developing roller by using the rotary knob 50.

However, the conventional roller spacing apparatus 1 has the spacing member 30 and the first and the second rotary members 41 and 42 located at one end portion of the shaft 21 of the developing roller 20 to space out the developing roller 20 from the photoconductive medium 10.

Accordingly, in operation, only one end portion of the developing roller 20 is spaced away from the photoconductive medium 10 by a distance corresponding to as much as the height of the spacing protrusion 35, and the opposite end portion of the developing roller 20 is not spaced apart from the photoconductive medium 10 by a distance corresponding to as much as the height of the spacing protrusion 35, and remains in the contact state with the photoconductive medium 10. As a result, an elastic layer formed on the opposite end of the developing roller 20 or on a corresponding portion of the photoconductive medium 10 must be physically and permanently compression set. Otherwise, high viscosity low molecular organic matter comes out of the elastic layer of the developing roller or the photoconductive medium, is combined with a developer, and thus is fixed to the surface of the developing roller and/or the photoconductive medium.

Since the conventional roller spacing apparatus 1 comprises complicated components, such as the spacing member 30, the first and the second rotary members 41 and 42, and the rotary knob 50, it is difficult to fabricate a metallic mold for the apparatus.

Also, in order to space out the developing roller 20 from the photoconductive medium 10, the conventional roller spacing apparatus 1 has to rotate the developing roller 20 about 180° in a direction opposite to the driving direction. Accordingly, when the developing roller 20 is rotated in the direction opposite to the direction of the driving direction, the developer is likely to flow out from the process cartridge and thus contaminate surrounding components.

Furthermore, since the conventional roller spacing apparatus 1 has no element to guide or restrict the movement of the spacing protrusion 35, which spaces out the developing roller 20 from the photoconductive medium 10, it is difficult to set the spacing protrusion 35 of the spacing member 30 above the driving gear 11 of the photoconductive medium 10. Also, when the image forming device or the process cartridge is delivered, the spacing protrusion 35 changes in position and thus a motion stability of the spacing member 30 (i.e., the ability of the spacing member 30 to remain in a predetermined position when the roller spacing apparatus 1 is moved) cannot be obtained.

SUMMARY OF THE INVENTION

The present general inventive concept has been developed in order to solve the above and/or other problems. Accordingly, the present general inventive concept provides a roller spacing apparatus that has a simplified structure, is able to stably operate, and prevents surrounding components from being contaminated by a leaked developer, and an image forming device having the same.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a roller spacing apparatus of an image forming device, the apparatus comprising a first rotatable roller member comprising a first shaft, a second rotatable roller member comprising a second shaft, the second rotatable roller member being rotatable in close contact with the first roller member under a predetermined pressure, and at least one spacing part to space the first and the second roller members apart from each other by a predetermined gap such that the first and the second roller members are not in contact with each other when the first and the second roller members are not in use, the at least one spacing part comprising a bushing member that has a bushing to rotatably support at least one of the first and second shafts, and a lever positioned at the bushing to rotate the bushing, the bushing having an outer diameter part and an inner diameter part to support at least one of the first and second shafts, the inner and outer diameter parts being non-concentric circles such that a center point of the inner diameter part is at a different location from a center point of the outer diameter part, and a stopping member to restrict an operation range of the lever.

The at least one spacing part may further comprise a first spacing part to space apart first ends of the first and second shafts from each other by the predetermined gap, and a second spacing part to space apart second ends of the first and second shafts from each other by the predetermined gap.

The stopping member may comprise a first stopping protrusion to restrict a first directional movement of the lever, and a second stopping protrusion to restrict a second, directional movement of the lever opposite to the first directional movement.

The spacing part may further comprise a position holding member to hold the lever such that the bushing is in a first position to bring the first and the second roller members into contact with each other or a second position to space the first and the second roller members apart from each other by the predetermined gap. The position holding member may comprise a position holding protrusion disposed between the first and the second stopping protrusions of the stopping member, the position holding protrusion being elastically movable between a up-position, in which the position holding protrusion is located within a moving path of the lever, and a down-position, in which the position holding protrusion is located outside of the moving path of the lever.

The first roller member may include a photoconductive medium capable of having an electrostatic latent image formed thereon, and the second roller member may include a developing roller to develop the electrostatic latent image.

The first roller member may include a photoconductive medium capable of having an electrostatic latent image formed thereon, and the second roller member may include a charging roller to charge the photoconductive medium with a predetermined electric potential.

The foregoing and/or other aspects and utilities of the present general inventive concept may also be achieved by providing a developing roller spacing apparatus of an image forming device, the apparatus comprising a photoconductive medium capable of having an electrostatic latent image formed thereon, the photoconductive medium comprising a first shaft, a developing roller that is rotatable in close contact with the photoconductive medium under a predetermined pressure to develop the electrostatic latent image, the developing roller comprising a second shaft, and at least one spacing part to space the photoconductive medium and the developing roller apart from each other by a predetermined gap such that the photoconductive medium and the developing roller are not in contact with each other when the photoconductive medium and the developing roller are not in use, the spacing part comprising a bushing member that has a bushing to rotatably support at least one of the first and second shafts, and a lever located at the bushing to rotate the bushing, the bushing having an inner diameter part for supporting at least one of the first and second shafts and an outer diameter part, the inner and outer diameter parts being non-concentric circles such that a center point of the inner diameter part is at a different location from a center point of the outer diameter part, a stopping member to restrict an operation range of the lever, and a position holding member to hold the lever such that the bushing is in a first position to bring the photoconductive medium and the developing roller into contact with each other or a second position to space the photoconductive medium and the developing roller apart from each other by the predetermined gap.

The foregoing and/or other aspects and utilities of the present general inventive concept may also be achieved by providing a charging roller spacing apparatus of an image forming device, the apparatus comprising a photoconductive medium capable of having an electrostatic latent image formed thereon, the photoconductive medium comprising a first shaft, a charging roller that is rotatable in close contact with the photoconductive medium under a predetermined pressure to charge the photoconductive medium with a predetermined electric potential to form the electrostatic latent image, the charging roller comprising a second shaft, and at least one spacing part to space the photoconductive medium and the charging roller apart from each other by a predetermined gap such that the photoconductive medium and the charging roller are not in contact with each other when the photoconductive medium and the charging roller are not in use, the at least one spacing part comprising a bushing member that has a bushing to rotatably support at least one of the first and second shafts, and a lever positioned at the bushing to rotate the bushing, the bushing having an inner diameter part for supporting at least one of the first and second shafts, and an outer diameter part, the inner and outer diameter parts being non-concentric circles such that a center point of the inner diameter part are at a different location from a center point of the outer diameter part, a stopping member to restrict an operation range of the lever, and a position holding member to hold the lever such that the busing is in a first position to bring the photoconductive medium and the charging roller into contact with each other or a second position to space the photoconductive medium and the charging roller apart from each other by the predetermined gap.

The foregoing and/or other aspects and utilities of the present general inventive concept may also be achieved by providing an image forming device comprises a body having a frame having a manipulation member located thereon, and a process cartridge comprising a first rotatable roller member comprising a first shaft, a second rotatable roller member that is rotatable in close contact with the first roller member under a predetermined pressure, the second rotatable roller member comprising a second shaft, at least one spacing part to space the first and the second roller members apart from each other by a predetermined gap such that the first and the second roller members are not in contact with each other when the first and the second roller members are not in use, and a housing to integrally modulate the first and the second members with the spacing part, is the housing being detachably mounted in the frame, the spacing part comprising a bushing member comprising at least one bushing and at least one lever operatable by an external force and the manipulation member to rotate the bushing, the bushing being rotatably disposed in the housing to rotatably support at least one of the first and second shafts, the bushing having an inner diameter part for supporting at least one of the first and second shafts and an outer diameter part, the inner and outer diameter parts being non-concentric circles such that a center point of the inner diameter part is at a different location from a center point of the outer diameter part.

The at least one spacing part may comprise a first spacing part to space first end portions of the first and second shafts apart from each other by the predetermined gap, and a second spacing part to space second end portions of the first and second shafts apart from each other by the predetermined gap.

The housing comprises a fixing hole and the bushing member may further comprise at least one hook member to lock the bushing onto one side edge of the fixing hole.

The spacing part may further comprise a stopping member to restrict an operation range of the lever.

The stopping member may comprise a first stopping protrusion to restrict one directional movement of the lever, and a second stopping protrusion to restrict a second, opposite directional movement of the lever.

The spacing part may further comprise a position holding member disposed at the housing to hold the lever such that the bushing is in a first position to bring the first and the second roller members into contact with each other or a second position to space the first and the second roller members apart from each other by the predetermined gap.

The position holding member may comprise a position holding protrusion disposed between the first and the second stopping protrusions of the stopping member, the position holding protrusion being elastically movable by an external force or by the lever between a up-position, where the position holding protrusion is located within a moving path of the lever, and a down-position, where the position holding protrusion is located outside of the moving path of the lever.

The first roller member may include a photoconductive medium capable of having an electrostatic latent image formed thereon, and the second roller member may include a developing roller to develop the electrostatic latent image.

The first roller member may include a photoconductive medium capable of having an electrostatic latent image formed thereon, and the second roller member may include a charging roller to charge the photoconductive medium with a predetermined electric potential.

The first roller member may include a photoconductive medium capable of having an electrostatic latent image formed thereon, and the second roller member may include a transfer roller to transfer a developer image from the photoconductive medium to a print medium or to an intermediate transfer medium.

The foregoing and/or other aspects and utilities of the present general inventive concept may also be achieved by providing a transfer roller spacing apparatus of an image forming device, the apparatus comprising a photoconductive medium capable of having an electrostatic latent image formed thereon, a transfer roller that is rotatable in close contact with the photoconductive medium under a predetermined pressure to transfer a developer image from the photoconductive medium to a print medium or to an intermediate transfer medium, and at least one spacing part to space the photoconductive medium and the transfer roller apart from each other by a predetermined gap such that the photoconductive medium and the transfer roller are not in contact with each other when the photoconductive medium and the transfer roller are not in use, the spacing part comprises a bushing member that has a bushing to rotatably support at least one of a photoconductive medium shaft and a transfer roller shaft and a lever disposed at the bushing to rotate the bushing, the bushing having an inner diameter part for supporting the at least one of a photoconductive medium shaft and a transfer roller shaft and an outer diameter part, the inner and outer diameter parts being non-concentric circles such that a center point of the inner diameter part is located apart from a center point of the outer diameter part, a stopping member to restrict an operation range of the lever, and a position holding member to hold the lever such that the bushing is in a first position to bring the photoconductive medium and the transfer roller into contact with each other, or a second position to space the photoconductive medium and the transfer roller apart from each other by the predetermined gap.

The foregoing and/or other aspects and utilities of the present general inventive concept may also be achieved by providing an image forming apparatus including a housing, a roller rotatably mounted on the housing, and a bushing member located between the housing and the roller, the bushing member having an outer diameter part rotatably mounted on the housing, a center, and an inner diameter part coupled to the roller, the inner diameter part having another center different from the center of the outer diameter part.

The foregoing and/or other aspects and utilities of the present general inventive concept may also be achieved by providing an image forming apparatus including a housing, a first roller rotatably mounted on the housing, a second roller rotatably mounted on the housing, and a bushing member located between the housing and one of the first roller and the second roller, the bushing member having an outer diameter part rotatably mounted on the housing and, the outer diameter having a first center, and an inner diameter part coupled to the one of the first roller and the second roller, the inner diameter part having a second center deviated from the first center. The image forming apparatus may further include a third roller rotatably mounted on the housing, and a second bushing member located between the housing and the third roller, the second bushing member having a second outer diameter part rotatably mounted on the housing, the second outer diameter part having a third center, and a second inner diameter part coupled to the third roller, the second inner diameter part having a fourth center deviated from the third center. The second center of the inner diameter part may move between two different positions with respect to the first center of the outer diameter part. The one of the first roller and the second roller may move between a contact position and a non-contact position with respect to the other one of the first roller and the second roller according to a movement of the second center between the two different positions. The housing may include a fixing hole to receive the bushing member and to correspond to the outer diameter part, and the one of the first roller and the second roller comprises a shaft to be inserted into the inner diameter part and having a shaft center corresponding to the second center. The first center, the second center, and the shaft center may be located within the fixing hole.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
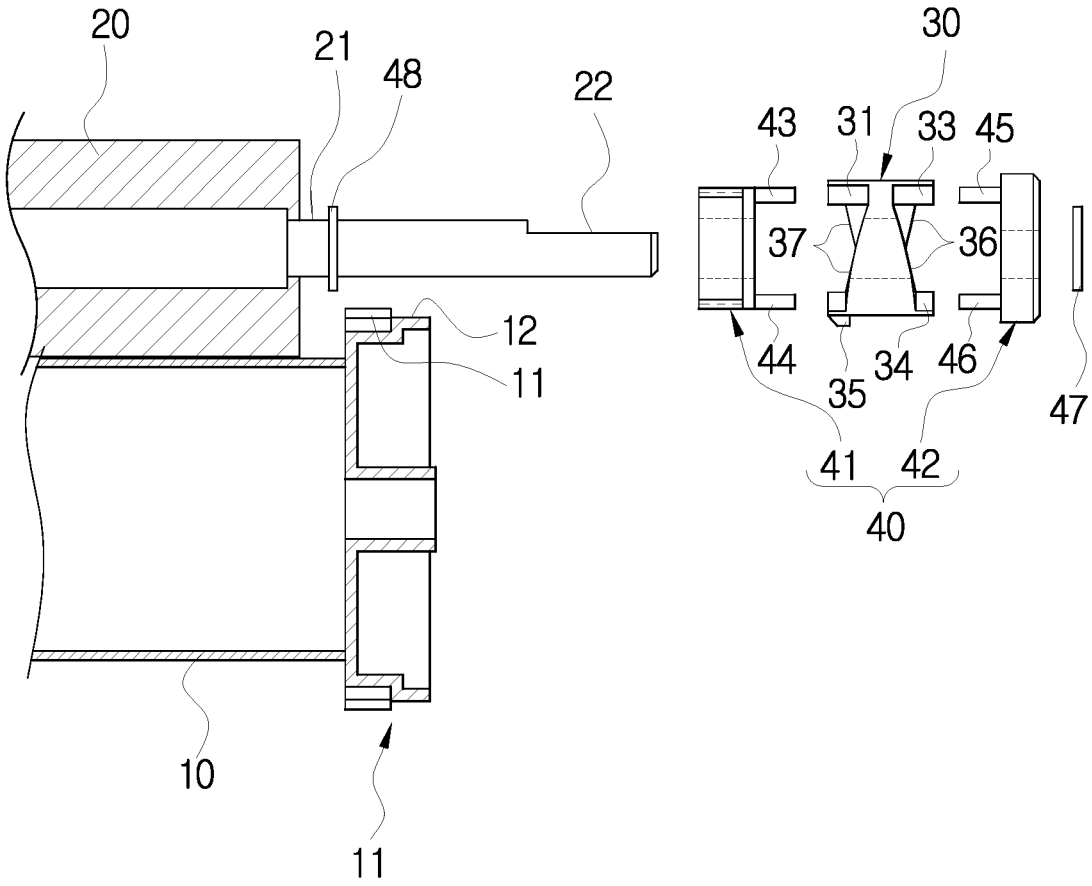
FIG. 1 (PRIOR ART)
FIG. 1 is an exploded cross section view illustrating a conventional roller spacing apparatus employed with a developing roller in an image forming device.
Figure 2:
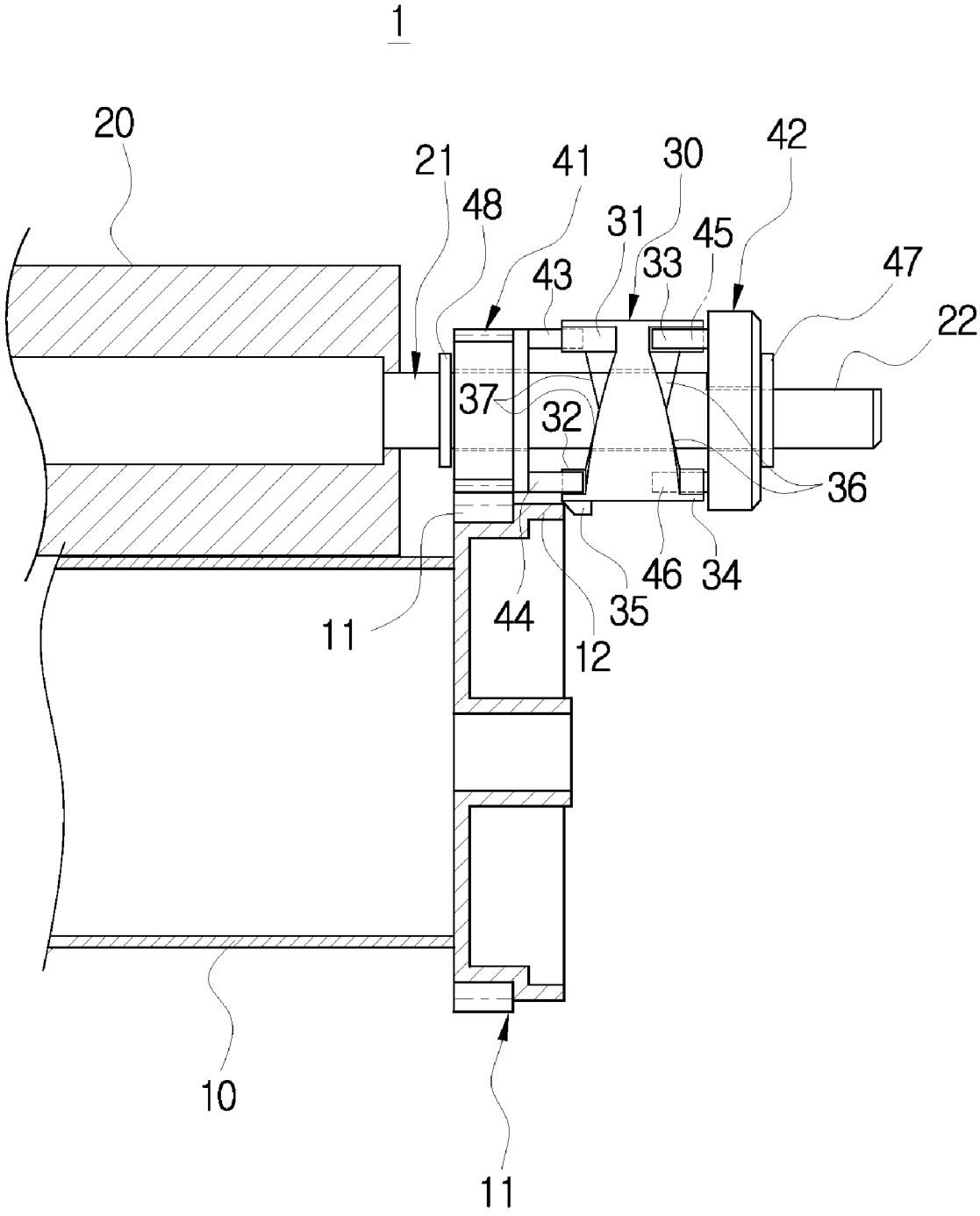
FIG. 2 (PRIOR ART)
FIG. 2 is an assembled cross section view illustrating the conventional roller spacing apparatus of FIG. 1 when a photoconductive medium and a developing roller are in close contact with each other.
Figure 3:
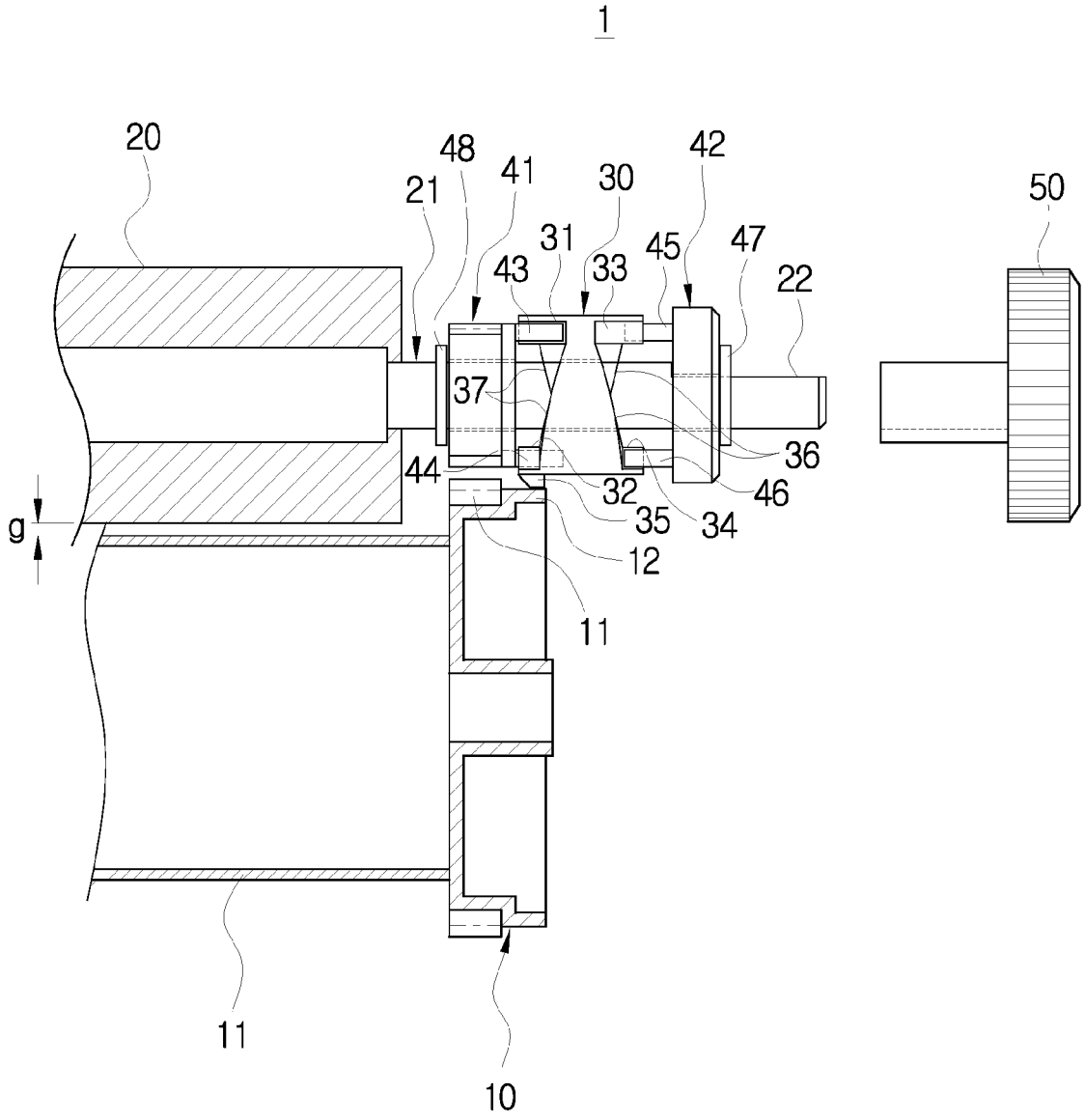
FIG. 3 (PRIOR ART)
FIG. 3 is an assembled cross section view illustrating the conventional roller spacing apparatus of FIG. 1 when the photoconductive medium and the developing roller are spaced apart from each other.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
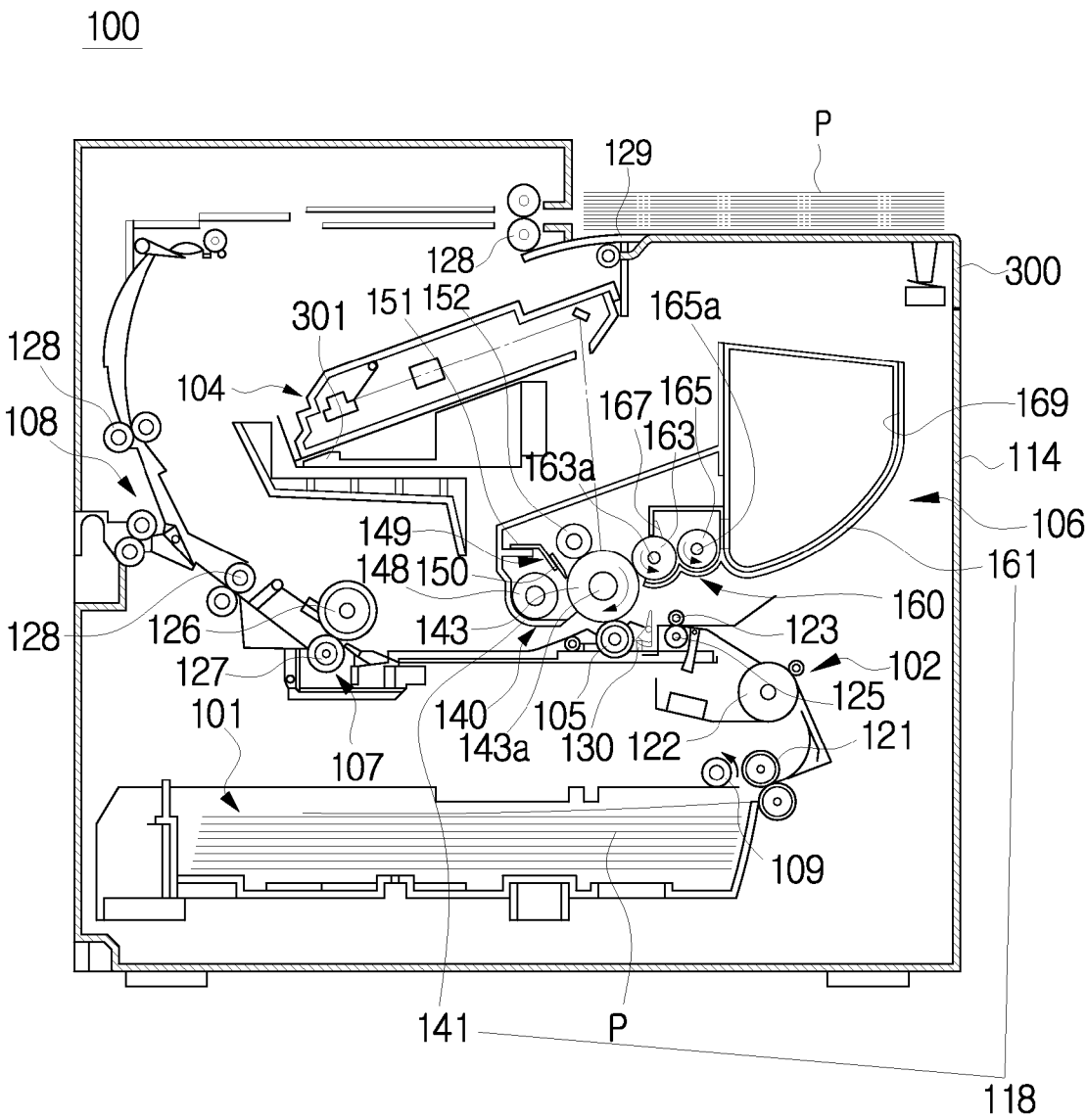
FIG. 4 is a schematic view illustrating a laser printer employing a roller spacing unit according to an embodiment of the present general inventive concept.

FIG. 4 is a schematic view illustrating an image forming device having a roller spacing apparatus according to an embodiment of the present general inventive concept. The present general inventive concept is not limited to the laser printer 100, however.

The image forming device according to the present general inventive concept may be a laser printer 100 that prints and outputs data input from an external device, such as a computer.

The laser printer 100 comprises a stack unit 101 to stack sheets of paper P, a transfer unit 102 to transfer the paper P from the stack unit 101, a process cartridge 106 to form a developer image on the paper P transferred by the transfer unit 102, a fusing unit 107 to fuse the developer image onto the paper P by using heat and pressure, and a discharge unit 108 to discharge the paper P having the developer image fused thereon.

The stack unit 101 includes a paper feeding cassette having a paper plate supported by a resilient spring to resiliently ascend and descend the paper P.

The transfer unit 102 comprises a pickup roller 109 to feed the paper P from the stack unit 101 sheet by sheet, a first transfer roller 121 and a second transfer roller 122 to transfer the paper P fed by the pickup roller 109, and a register roller 123 and a backup roller 125 to align a leading end of the paper P transferred by the first and the second transfer rollers 121 and 122.

A paper sensor 130 is located behind the register roller 123, i.e., downstream of a paper conveyance path, to detect a location of the leading end of the paper P.

The process cartridge 106 comprises a photoconductive medium unit 140, a developing unit 160, a roller spacing unit 200 (see FIGS. 5 and 6), and a housing 118 to integrate the photoconductive medium unit 140, the developing unit 160, and the roller spacing unit 200 into a single assembly unit detachably mountable in a frame (not illustrated) of a body 114 of the laser printer 100.

Figure 5:
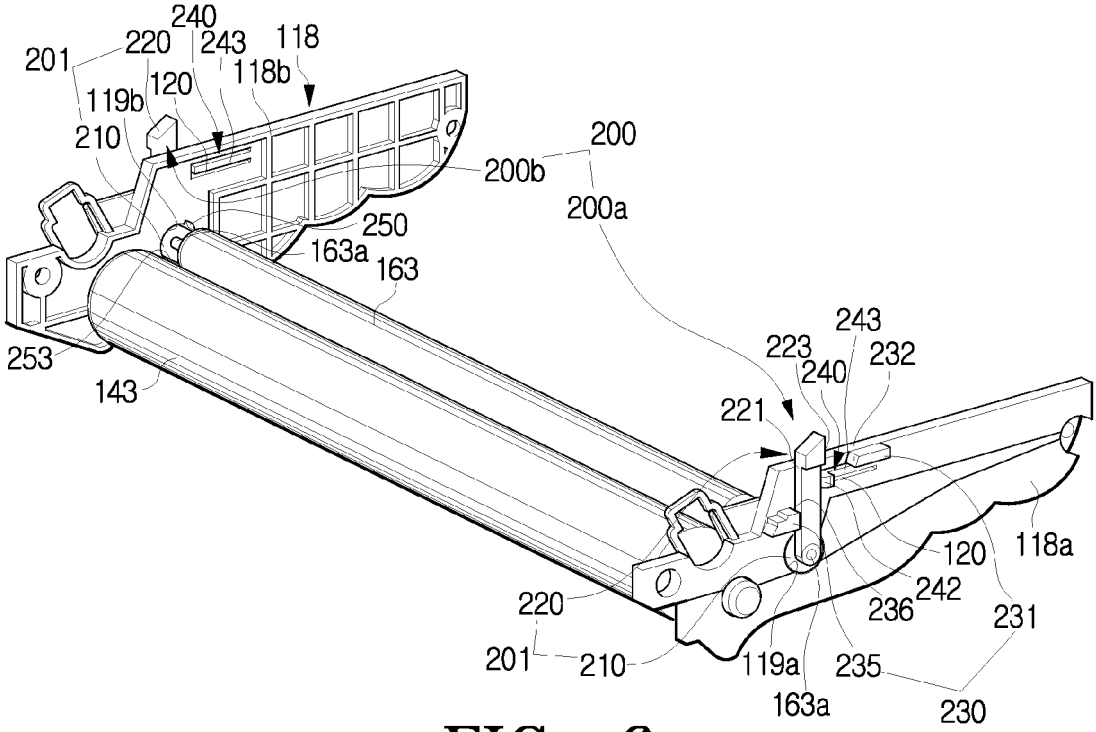
FIGS. 5 and 6 are partial perspective views illustrating a photoconductive medium, a developing roller, and a roller spacing unit of a process cartridge of the laser printer of FIG. 4.
Figure 6:
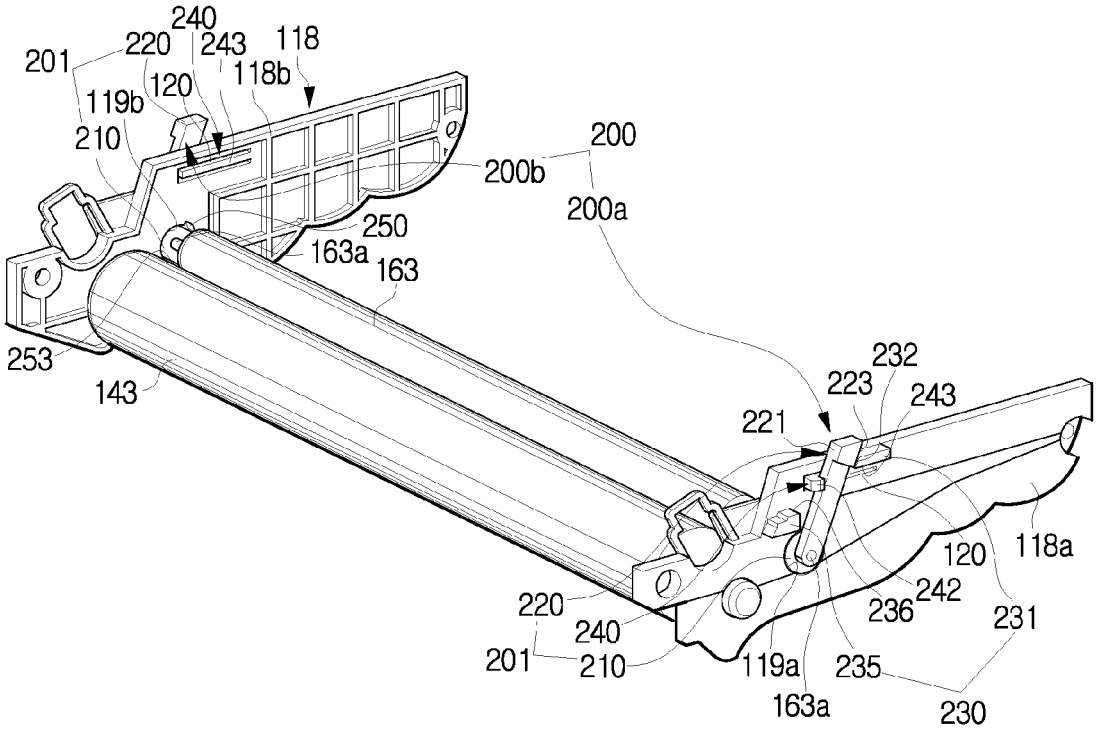

The photoconductive medium unit 140 comprises a photoconductive medium 143 having opposite ends rotatably supported by a right sidewall 118*a* and a left sidewall 118*b*, respectively, of the housing 118 (see FIGS. 5 and 6). The photoconductive medium 143 may be, for example, an organic photoconductive drum (OPC).

The photoconductive medium 143 comprises a photoconductive medium gear (not illustrated) disposed at a left side end portion of a photoconductive medium shaft 143*a* protruding from the left sidewall 118*b* of the housing 118. When the process cartridge 106 is mounted in the frame of the body 114, the photoconductive medium gear is engaged with a driving gear (not illustrated) of a photoconductive medium gear train (not illustrated) that receives a driving force form a photoconductive medium driving motor (not illustrated) disposed in the body 114. The photoconductive medium 143 is rotated in one direction, e.g., in a clockwise direction, by the driving gear of the photoconductive medium gear train. Since the structure of the photoconductive medium gear train is the same as that of well-known photoconductive medium gear trains, detailed descriptions and illustrations thereof are omitted.

A charge eliminator 148, a photoconductive medium cleaner 149 and a charger 152 are arranged at predetermined locations around an outer circumference of the photoconductive medium 143 in a rotation direction.

The charge eliminator 148 may use a charge eliminating lamp to eliminate electric potentials charged on a surface of the photoconductive medium 143.

The photoconductive medium cleaner 149 removes developer that remains on the surface of the photoconductive medium 143 after the developer image is transferred from the photoconductive medium 143 to the paper P by a transfer roller 105 (i.e., developer waste), and comprises a cleaning member 150, such as a cleaning blade. In embodiments, the developer image may be transferred to an intermediate transfer medium to be later transferred to the paper P, as opposed to being directly-transferred to the paper P as described above. For example, the developer image may be transferred from the photoconductive medium 143 to a recording medium through an intermediate transfer roller, and/or to a storage medium.

The cleaning member 150 is located at a cleaning member fixing bracket 151 positioned in a photoconductive medium casing 141 such that the cleaning member 150 contacts the photoconductive medium 143 under a predetermined pressure.

The charger 152 includes a charging roller that is disposed in contact with the surface of the photoconductive medium 143, and forms a predetermined charging electric potential on the surface of the photoconductive medium 143 by applying a predetermined charging bias voltage from a charging bias power supply (not illustrated).

The developing unit 160 comprises a developing roller 163 located in a developing casing 161 opposite the photoconductive medium 143 and separated from the photoconductive medium 143 by a predetermined gap, a supply roller 165 to supply the developer to the developing roller 163, a developer regulating blade 167 to regulate a thickness of a developer layer adhered to the developing roller 163, and a developer storage part 169 to store the developer.

The developing roller 163 develops an electrostatic latent image formed on the photoconductive medium 143 by an LSU 104 by adhering the developer to the image. The developing roller 163 is opposite to, and spaced apart from, the photoconductive medium 143 by a predetermined gap G (see FIG. 11). A predetermined developing bias voltage is applied to the developing roller 163 at a level that is lower than a bias voltage applied to the supply roller 165 from a developing bias power supply (not illustrated).

The developing roller 163 comprises a developing roller gear (not illustrated) formed at a left side end portion of a developing roller shaft 163*a* protruding from the left sidewall 118*b* of the housing 118. The developing roller gear is engaged with the photoconductive medium gear through an idle gear and a deceleration gear (not illustrated). Accordingly, when the photoconductive medium 143 is rotated in the clockwise direction, the developing roller 163 is rotated in an opposite direction, i.e. in a counter clockwise direction, by the photoconductive medium gear, the idle gear, the deceleration gear, and the developing roller gear.

The supply roller 165 supplies the developer to the developing roller 163 by using a potential difference between the supply roller 165 and the developing roller 163, and is in contact with one side of the developing roller 163 to form a nip. The developer is conveyed to a lower space between the supply roller 165 and the developing roller 163 by the supply roller 165 in the developing casing 161.

The supply roller 165 comprises a supply roller gear (not illustrated) formed on a left side end portion of a supply roller shaft 165*a* protruding from the left sidewall 118*b* of the housing 118. The supply roller gear is engaged with the deceleration gear, which is engaged with the developing roller gear. Accordingly, when the photoconductive medium 143 is rotated in the counter clockwise direction, the supply roller is rotated in the same direction, i.e., in the counter clockwise direction, by the photoconductive medium gear, the idle gear, the deceleration gear, and the supply roller gear.

A predetermined developer supply bias voltage is applied to the supply roller 165 at a level higher than a bias voltage applied to the developing roller 163 by the developer supply bias power supply (not illustrated). Accordingly, the developer conveyed to the lower space between the supply roller 165 and the developing roller 163 is supplied with an electric charge from the supply roller 165 and carries the electric charge, thereby being attracted to the developing roller 163 having a relatively low level of electric charge, and conveyed to the nip between the supply roller 165 and the developing roller 163.

The developer regulating blade 167 regulates the developer supplied to the developing roller 163 through the supply roller 165 such that a film formed on the developing roller 163 has a predetermined thickness.

The developer storage part 169 contains and stores the developer and is detachably mountable in the developing casing 161. An agitator (not illustrated) is disposed in the developer storage part 169 to agitate the stored developer. Since the agitator has the same structure as that of well-known agitators, detailed descriptions and illustrations thereof will be omitted.

Figure 7:
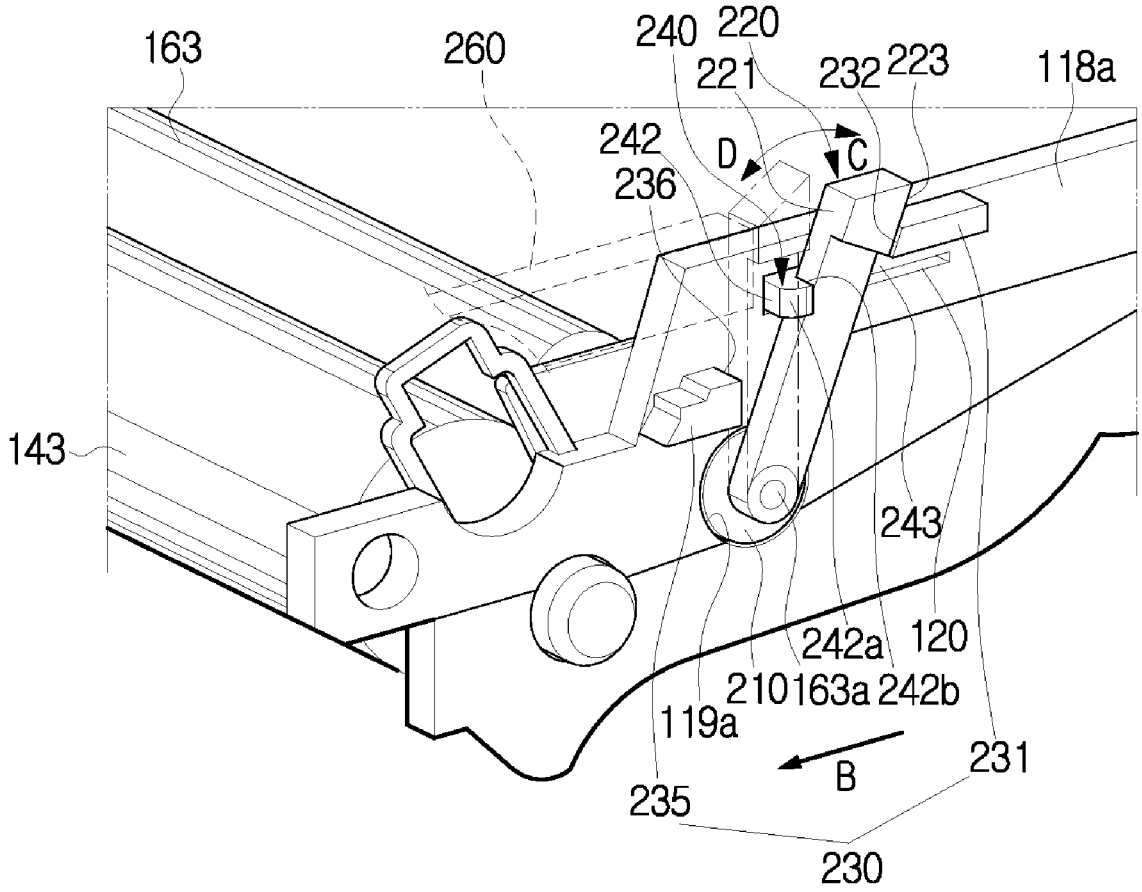
FIG. 7 is a perspective view illustrating a right spacing part of the roller spacing unit of FIG. 6.

The roller spacing unit 200 as illustrated in FIGS. 5 to 7 spaces the developing roller 163 apart from the photoconductive medium 143 by a predetermined distance to maintain the developing roller 163 and the photoconductive medium 143 in a non-contact state when the laser printer or the process cartridge 106 is not in use, such as until the laser printer or the process cartridge 106 is delivered to a user. The roller spacing unit 200 comprises a right spacing part 200*a* and a left spacing part 220*b*. The right spacing part 200*a* and the left spacing part 220*b* have the same structure, except that the right spacing part 200*a* is disposed at the right sidewall of the housing 118 and a right side end portion of the developing roller 163, and the left spacing part 220*b* is disposed at the left sidewall of the housing 118 and a left side end portion of the developing roller 163. Therefore, only the right spacing part 200*a* will be explained hereinbelow for the sake of brevity. However, the description of the right spacing part 200*a* also applies to the left spacing part 200*b*.

The right spacing part 200*a* spaces the right side end portion of the developing roller 163 from a corresponding right side end portion of the photoconductive medium 143, and comprises a bushing member 201 and a stopping member 230.

The bushing member 201 comprises a bushing 210 rotatably supported in a fixing hole 119*a* formed on the right sidewall 118*a*.

Figure 8A:
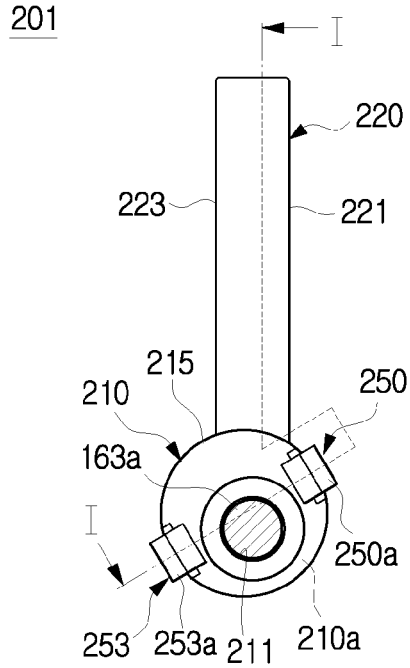
FIGS. 8A to 8B are a left surface view and a right surface view, respectively, illustrating a bushing member of the right spacing part of the roller spacing unit of FIG. 6.
Figure 8B:
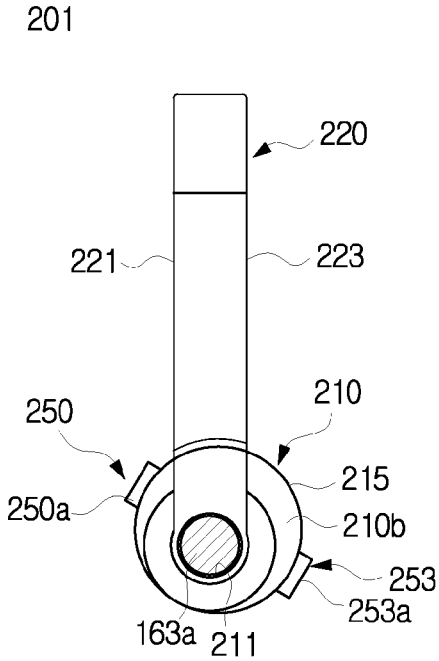
Figure 10:
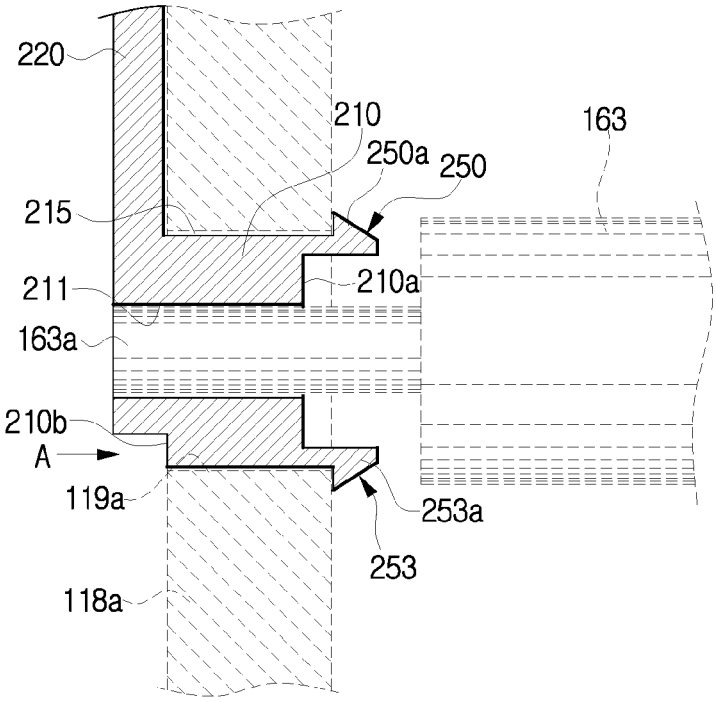
FIG. 10 is a partial cross section view taken along the line I-I of FIG. 8A, illustrating the bushing member of the right spacing part of the roller spacing unit of FIG. 6 in an assembled state.

As illustrated in FIGS. 8A, 8B, and 10, an inner diameter part 211 of the bushing 210 rotatably supports the right side end portion of the developing roller shaft 163*a* of the developing roller 163 inserted into the inner diameter part 211, and an outer diameter part 215 of the bushing 210 is rotatably supported by the fixing hole 119*a* of the right sidewall 118*a*.

Figure 11:
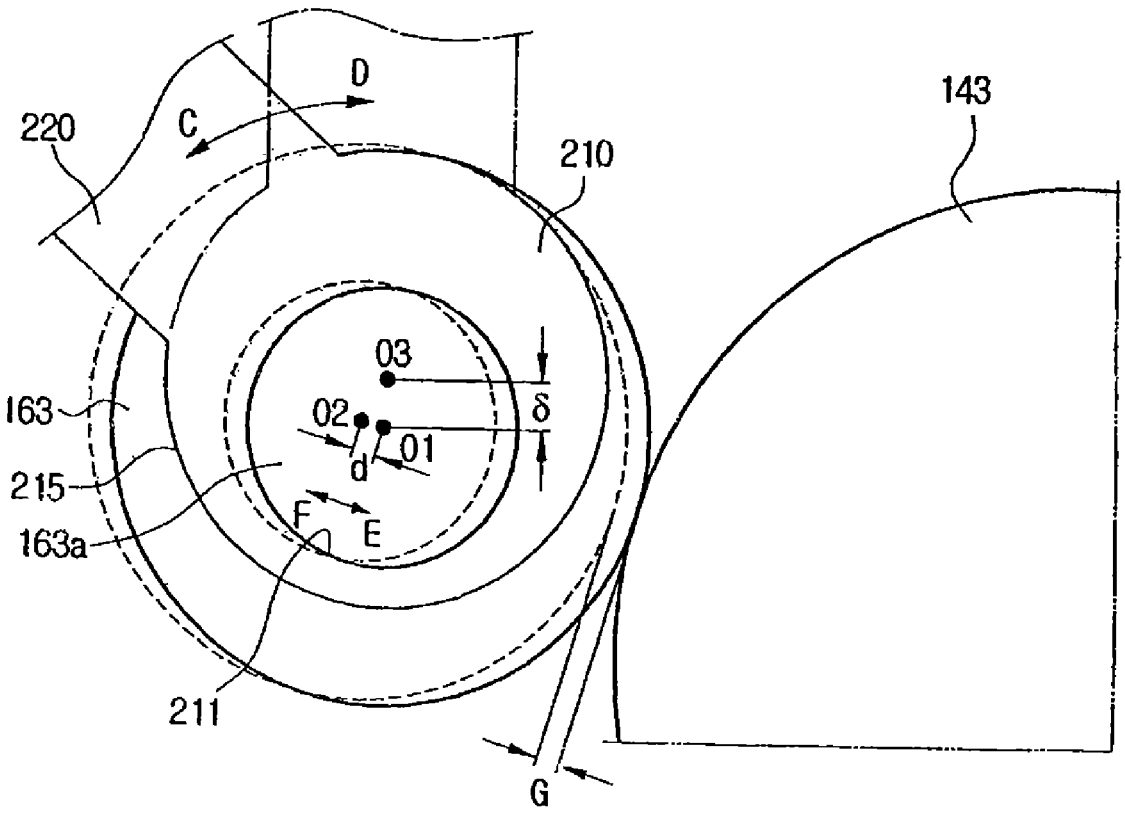
FIG. 11 is a view illustrating the bushing member of the right spacing part of the roller spacing unit of FIG. 7.

As illustrated in FIG. 11, the inner diameter part 211 to support the right side end portion of the developing roller shaft 163*a* and the outer diameter part 215 are non-concentric circles such that the inner and outer diameters do not have a common center, e.g., a first center point 01 of the inner diameter part 211 is distanced from a third center point 03 of the outer diameter part 215 by δ. Accordingly, when the bushing 210 is rotated from a first position drawn by a solid line to a second position drawn by a dashed line by a lever 220 (described below), the first center point 01 of the inner diameter part 211 is shifted (moved) to a second center point 02, and the right side end portion of the developing roller shaft 163*a* is moved as much as a predetermined distance d and thereby moves the developing roller 163 from a normal position (solid line) to a separation position (dashed line). In the normal position, the developing roller 163 closely contacts the photoconductive medium 143 under a predetermined pressure. In the separation position, the developing roller 163 is spaced apart from the photoconductive medium 143 by the predetermined gap G.

Referring back to FIGS. 5, 6, 8A, 8B, and 10, an inner end portion 210*a* of the bushing 210 has a first hook member 250 and a second hook member 253, which each protrude from the inner end portion 210*a* by a predetermined distance and each have a resilience. The first and the second hook members 250 and 253 comprise hook protrusions 250*a* and 253*a* formed at ends thereof, respectively. The inner end portion 210*a* of the bushing 210 is moved towards the fixing hole 119*a* from an outside of the right sidewall 118*a* in a direction A (see FIG. 10) in order for the bushing 210 to be inserted through the fixing hole 119*a*. The hook protrusions 250*a* and 253*a* of the first and the second hook members 250 and 253 are inserted through the fixing hole 119*a* along with the bushing 210 and are locked onto an inner edge of the fixing hole 119*a* while the developing roller shaft 163*a* of the developing roller 163 is inserted into the bushing, 210 through the inner diameter part 211.

The bushing member 201 has the lever 220 to rotate the bushing 210. The lever 220 vertically protrudes from an outer end portion 210*b* of the bushing 210.

The lever 220 may be operated by the user to rotate the bushing 210 to the first position (solid line of FIGS. 6, 7 and 11) and the second position (dashed line of FIGS. 5, 7 and 11). The lever 220 may also be operated by a force from a manipulating member 260 (see FIG. 7) disposed in the frame when the process cartridge 106 is mounted in the frame of the body 114 to rotate the bushing 210 from the second position to the first position.

In addition, the lever 220 prevents the bushing 210 from further moving in the direction A by contacting the right sidewall 118*a* after the hook protrusions 250*a* and 253*a* are locked onto the inner edge of the fixing hole 119*a* when the bushing 210 is inserted through the fixing hole 119*a*. Accordingly, the bushing 210 does not escape from the fixing hole 119 and instead remains fixed due to the presence of the lever 220 and the first and the second hook members 250 and 253.

As illustrated in FIGS. 5-7 and 9, the stopping member 230 restricts a rotation range of the lever.

The stopping member 230 comprises a first stopping protrusion 231 and a second stopping protrusion 235, which are disposed on an outer surface of the right sidewall 118*a* and spaced apart from each other by a predetermined distance. The first stopping protrusion 231 has a first inclination surface 232 formed at one end thereof to restrict one directional movement of the lever 220. That is, the first inclination surface 232 prevents the lever 220 from further moving beyond an inclination position where the bushing 210 is maintained in the first position. The second stopping protrusion 235 has a first vertical surface 236 to restrict the opposite directional movement of the lever. That is, the first inclination surface 236 prevents the lever 220 from further moving beyond a vertical position where the bushing 210 is maintained in the second position. Accordingly, when the lever 220 is operated by the user or by the manipulating member 260 of the frame to rotate the bushing 210 from the first position to the second position or from the second position to the first position, the lever 220 does not move the bushing 210 beyond the first or second position and accurately stops after moving the bushing 210 to the first or second position.

Also, the right spacing part 200*a* further comprises a position holding member 240 to hold the lever 220 in a position after the lever 220 moves the bushing 210 to the first or second position.

Figure 9:
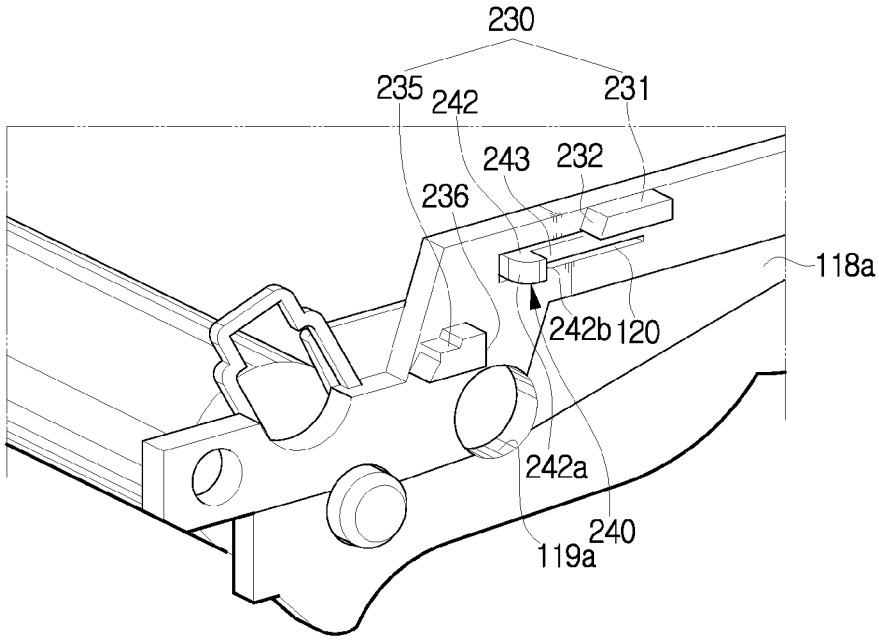
FIG. 9 is a partial perspective view illustrating the right spacing part of the roller spacing unit of FIG. 7.

The position holding member 240 has a position holding protrusion 242 having a support portion 243 integrally formed with the right sidewall 118*a* and defined by a cutting portion 120 so as to elastically move between an up position and a down position. In the up position, the position holding protrusion 242 pops out toward a moving path of the lever 220, and in the down position, the position holding protrusion 242 departs away from the moving path of the lever 220. As illustrated in FIGS. 7 and 9, the position holding protrusion 242 comprises a second inclination surface 242*a* facing the first vertical surface 236 of the second stopping protrusion 235, and a second vertical surface 242*b* facing the first inclination surface 232 of the first stopping protrusion 231.

When the lever is in the vertical position and the inclination position as illustrated as the chain and solid lines of FIG. 7, the position holding protrusion 242 brings the second inclination surface 242*a* and the second vertical surface 242*b* into contact with a second operation surface 223 and a first operation surface 221 of the lever 220, respectively, and thus maintains the lever 220 in the vertical position and the inclination position by its own resilient force. When the process cartridge 106 is mounted in the frame of the body 114 in the direction of arrow B and thus the lever 220 is pushed by the manipulating member 260 of the frame in the direction of arrow C, the position holding protrusion 242 is moved to the down position by the second operation surface 223 of the lever 220 and moves the lever 220 to the inclination position.

Operations of assembling the roller spacing unit 200 described above with the process cartridge 106 and mounting the assembled process cartridge 106 to the body 114 will now be described.

First, the process cartridge 106 incorporating elements, except the roller spacing unit 200 and the right and the left spacing parts 200*a* and 200*b* of the roller spacing unit 200, are prepared.

In order to position the right spacing part 200*a* through the fixing hole 119*a* of the right sidewall 118*a*, the right end portion of the developing roller shaft 163*a* is inserted into the inner diameter part 211 of the bushing 220 of the right spacing part 200*a*. At the same time, the inner end portion 210*a* of the bushing 210 is inserted through the fixing hole 119*a* in the direction of arrow A (see FIG. 10). At this time, the first and the second hook members 250 and 253 are inserted through the fixing hole 119*a* along with the inner end portion 210*a* of the bushing 210.

After that, as illustrated in FIG. 10, when the hook protrusions 250*a* and 253*a* of the first and the second hook members 250 and 253 are locked onto the inner edge of the fixing hole 119*a*, the lever 220 contacts the outer surface of the right sidewall 118*a*, thereby preventing the bushing from further being inserted in the direction of arrow A. Due to the presence of the lever 220 and the first and the second hook members 250 and 253, the bushing 210 does not escape from the fixing hole 119*a* and is rotatably fixed.

If the lever is in the vertical position as illustrated as the dashed line in FIGS. 7 and 11 (i.e., if the bushing 210 is in the second position), the developing roller 163 and the photoconductive medium 143 are spaced apart from each other by the predetermined gap G.

In the same way as the right spacing part 200*a*, the left spacing part 200*b* is positioned through the fixing hole 119*b* of the left sidewall 118*b*.

The process cartridge 106 assembled with the right and the left spacing parts 200*a* and 200*b* of the roller spacing unit 200 is placed in the body 114 through a door 300 of the image forming device (see FIG. 4) to perform a test printing operation for an image quality test.

Next, as illustrated in FIG. 7, the process cartridge 106 moves along a mounting guide (now illustrated) formed in the frame of the body 114 in the direction of arrow B.

After that, as the process cartridge 106 is mounted in the frame, the manipulating member 260 of the frame pushes the lever 220 of each of the right and the left spacing parts 200*a* and 200*b* in a direction of an arrow C.

Accordingly, the lever 220 is rotated on the second center point 02 of the inner diameter 211 of the bushing 210 (which is in the second position drawn as dashed line in FIG. 11), bringing the second operation surface 223 into contact with the second inclination surface 242*a* of the position holding protrusion 242 and pushing the second inclination surface 242*a* in the direction of the arrow C. The position holding protrusion 242 pushed by the lever 220 is moved from the up position to the down position. Accordingly, the lever 220 is rotated to the inclination position after passing the position holding protrusion 242. The center point of the inner diameter 211 of the bushing 210 moves from the second center point 02 to the first center point 01 by as much as the predetermined distance d towards the photoconductive medium 143 (as illustrated as the solid line in FIG. 11), and the right and the left end portions of the developing roller shaft 163*a* supported by the inner diameter part 211 move towards the photoconductive medium 143 by as much as the distance d. As a result, the photoconductive medium 143 and the developing roller 163 are in a normal position (solid line of FIGS. 6, 7 and 11) i.e., in close contact with each other under a predetermined pressure.

In this state, the test printing is performed and then the process cartridge is detached and dismounted from the body 114 to be packaged separately from the body 114.

If the process cartridge dismounted from the body 114 is not in use (e.g., until the process cartridge 106 is delivered to the user), the elastic layer and the surface of the photoconductive medium 143 and/or the developing roller 163 may be physically and chemically deformed or damaged. In order to prevent the deformation, the roller spacing unit 200 spaces out the developing roller 143 from the photoconductive medium 143.

More particularly, when the position holding protrusion 242 formed at the right and left sidewalls 200*a* and 200*b* is moved from the up position to the down position by the user, the lever 220 of each of the right and the left spacing parts 200*a* and 200*b* is rotated by the user in a direction of an arrow D until the first operation surface 221 is brought into contact with the first vertical inclination surface 236 of the second stopping protrusion 235.

After that, when the lever 220 is in the vertical position as illustrated as the dashed line in FIGS. 7 and 11, the center point of the inner diameter part 211 of the bushing 220 moves from 01 to 02 by as much as the predetermined distance d away from the photoconductive medium 143, and the right and left end portions of the developing roller shaft 163*a* supported by the inner diameter part 211 are spaced apart from the photoconductive medium 143 by as much as the distance d. As a result, the photoconductive medium 143 and the developing roller 163 are spaced apart from each other by the predetermined gap G (dashed line of FIGS. 5, 7 and 11).

The process cartridge 106, which is dismounted from the body 114 and has the developing roller 143 and the photoconductive medium 163 spaced apart from each other, is packaged separately from the body 114 and thus comes separately-packaged to the user.

The process cartridge 106 is then delivered to the user and is mounted to the body 114 according to the above-described mounting process.

Referring back to FIG. 4, the LSU 104 is fixed to an LSU fixing bracket 301 above the process cartridge 106. The LSU 104 scans the surface of the photoconductive medium 143, which is charged with the predetermined electric potential by the charger 152 by laser beams emitted from a laser diode according to an image signal input from an external device (such as PC), and thereby forms an electrostatic latent image having a low level of electric potential that is lower than the charging electric potential.

Under the photoconductive medium 143 of the process cartridge is disposed the transfer roller 105.

The transfer roller 105 transfers the developer image formed on the photoconductive medium 143 to the paper P and is arranged to apply a predetermined pressure to the photoconductive medium 143. A predetermined transfer bias voltage is applied to the transfer roller 105 from a transfer bias power supply (not illustrated) to transfer the developer image formed on the photoconductive medium 143 to the paper P. As discussed above, the transfer roller 105 may transfer the developer image to an intermediate transfer medium before or instead of transferring the developer image to the paper P.

The fusing roller 107 comprises the heating roller 126 to heat the developer image transferred from the photoconductive medium 143 to the paper P by the transfer roller 105, and the compression roller 127 to apply a pressure to the developer image.

The discharging unit 108 comprises the discharge roller 128 to discharge the printing-completed paper P and the stack 129 to stack and support the discharged paper P.

According to the present general inventive concept as described above, the roller spacing unit 200 of the laser printer 100 comprises the right and the left spacing parts 200*a* and 200*b* to space apart the photoconductive medium 143 and the developing roller 163 (which are in close contact with each other during a rotation operation) from each other when the photoconductive medium 143 and the developing roller 163 are not in use. Accordingly, it is possible to prevent the elastic layer from being physically and permanently compression-set, to prevent an image degradation that is caused when a high viscosity low molecular organic matter comes out from the surface of the elastic layer and is adhered to a surface in combination with the developer, and also to prevent a reliability of a product from being reduced.

Since the right and the left spacing parts 200*a* and 200*b* of the roller spacing unit 200 use the relatively simplified bushing member 201, the stopping member 230, and the position holding member 240, it is to easy to fabricate a metal mold and thus to reduce manufacturing costs.

Also, according to the present general inventive concept, in order to space apart the photoconductive medium 143 and the developing roller 163 from each other by the predetermined gap G, the roller spacing unit 200 does not rotate the developer roller 163 and instead rotates the bushing 210 supporting the developing roller shaft 163*a*. Therefore, it is possible to prevent the developer in the process cartridge from leaking and contaminating the surrounding components that occurs when the conventional roller spacing apparatus 1 rotates the developing roller 20 to space the developing roller 20 apart from the photoconductive medium 10.

Also, according to the present general inventive concept, the roller spacing unit 200 comprises the stopping member 230 and the position holding member 240 to guide and restrict the movement of the lever 220 such that the bushing 220 is in the first position when the photoconductive medium 143 and the developing roller 163 are in contact with each other, and in the second position when the photoconductive medium 153 and the developing roller 163 are spaced apart from each other by the predetermined gap G. Accordingly, it is possible to set the lever 220 to an accurate position, thus guaranteeing stable operation of the lever. Also, it is possible to prevent the lever 220 from changing position during delivery of the process cartridge 106.

According to the present general inventive concept, the roller spacing unit 200 of the process cartridge 106 of the laser printer 100 is employed to space apart the photoconductive medium 143 and the developing roller 163 from each other by the predetermined gap or to bring them into contact with each other. However, this should not be considered as limiting. The roller spacing unit 200 according to the present general inventive concept is applicable to any two rollers that are rotated in close contact with each other under a predetermined pressure by the same structure and principle. For example, the roller spacing unit 200 may space apart the photoconductive medium 143 and a charging roller of the charger 152 from each other or may bring them into contact with each other. Similarly, the roller spacing unit 200 may space apart the photoconductive medium 143 and the transfer roller 105 from each other or may bring them into contact with each other.

Although the roller spacing unit 200 is employed in the laser printer 100, it can be employed in another image forming device having the process cartridge, such as a photocopier and a facsimile machine, and other devices with the same or similar structure and principle.

An operation of the laser printer 100 having the process cartridge 106 mounted therein and having the roller spacing unit 200 according to the present general inventive concept will now be described below with reference to FIG. 4.

When a document print command is input from, for example, an external PC, a controller (not illustrated) of the printer 100 drives the pickup roller 109 to pick up the paper P stacked on an uppermost portion of the stack unit 101. The paper P is conveyed to the register roller 123 by the first and the second transfer rollers 121 and 122.

The leading end of the paper P conveyed to the register roller 123 is aligned by the nip formed between the register roller 123 and the backup roller 125.

After that, the paper P passes by the nip between the register roller 123 and the backup roller 125 and continues to move. The leading end of the paper P operates the paper sensor 130 disposed between the register roller 123 and the transfer roller 105, and the paper sensor 130 transmits a paper detection signal to the controller.

The controller counts time until the paper P moves from the paper sensor 130 to the transfer roller 105 according to the paper detection signal. After the paper P is conveyed for a predefined time corresponding to the time required to convey the paper P to a print beginning point, the process cartridge 106 and the transfer roller 105 are operated.

While the paper P is conveyed to the print beginning point, an electrostatic latent image is formed on the photoconductive medium 143 of the process cartridge 106 by laser beams emitted from the LSU 104 according to the image signal, and the electrostatic latent image formed on the photoconductive medium 143 is developed into a visible developer image by the developing roller 163.

After that, when the paper P reaches the photoconductive medium 143 of the process cartridge 106, the developer image formed on the photoconductive medium 143 is transferred to a surface of the paper P by the transfer roller 105 under the control of the controller. As discussed above, the transfer roller 105 may transfer the developer image to an intermediate transfer member before or instead of transferring the developer image to the paper P.

The developer image transferred to the surface of the paper P is fused onto the paper by heat from the heating roller 126 and pressure from the compression roller 127 while passing by the fusing unit 107, and the paper onto which the developer image is fused is discharged towards the stack 129 by the discharge roller 128 of the discharging unit 108.

The above-described operations of picking up, developing, fusing, and discharging are performed with respect to the next paper P repeatedly until all of the contents of the documents are printed.

According to the present general inventive concept as described above, the roller spacing unit and the laser printer having the same comprise right and the left spacing parts to space apart two rollers (such as the photoconductive medium and the developing roller or the charging roller, which are in close contact with each other during the rotation operation) from each other when the two rollers are not in use. Accordingly, it is possible to prevent an elastic layer from being physically and permanently compression-set, to prevent image degradation caused when a high viscosity, low molecular organic matter comes out of the elastic layer and is adhered to a surface in combination with the developer, and also to prevent a reliability of a product, such as an image forming apparatus and a process cartridge, from being reduced.

Since the roller spacing unit and the image forming device having the same use a relatively simplified bushing member, stopping member and position holding member, it is to easy to fabricate a metal mold and thus a manufacturing cost can be reduced.

Also, according to the present general inventive concept, in order to space apart the two rollers from each other by a predetermined gap, the roller spacing unit and the image forming device having the same do not rotate the rollers and instead rotate the bushing supporting a shaft of at least one of the two rollers. Therefore, it is possible prevent the developer in the process cartridge from leaking and contaminating the surrounding components, which occurs when the conventional roller spacing apparatus 1 rotates a roller to space out the two rollers.

Also, according to the present general inventive concept, the roller spacing unit and the image forming device comprise the stopping member and the position holding member to guide and restrict the movement of the lever such that the bushing is in the first position when the photoconductive medium and the developing roller or the charging roller are in contact with each other, and in the second position when the two rollers are spaced apart from each other by the predetermined gap. Accordingly, it is possible to set the lever to an accurate position and to guarantee the stable operation of the lever. Also, it is possible to prevent the lever from changing position during delivery of the process cartridge.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A roller spacing apparatus of an image forming device, the apparatus comprising:

a first rotatable roller member comprising a first shaft;

a second rotatable roller member comprising a second shaft, the second rotatable roller member being rotatable in close contact with the first roller member under a predetermined pressure; and at least one spacing part to space the first and the second roller members apart from each other by a predetermined gap such that the first and the second roller members are not in contact with each other when the first and the second roller members are not in use, the at least one spacing part comprising:

a bushing member that has a bushing to rotatably support at least one of the first and second shafts, and a lever positioned at the bushing to rotate the bushing, the bushing having an outer diameter part and an inner diameter part to support at least one of the first and second shafts, the inner and outer diameter parts being non-concentric circles such that a center point of the inner diameter part is at a different location from a center point of the outer diameter part;

a stopping member to restrict an operation range of the lever; and a position holding member to hold the lever such that the bushing is in a first position to bring the first and the second roller members into contact with each other or a second position to space the first and the second roller members apart from each other by the predetermined gap, wherein the position holding member comprises a position holding protrusion, the position holding protrusion being elastically movable between a up-position, in which the position holding protrusion is located within a moving path of the lever, and a down-position, in which the position holding protrusion is located outside of the moving path of the lever.

2. The roller spacing apparatus as claimed in claim 1, wherein the at least one spacing part further comprises a first spacing part to space apart first ends of the first and second shafts from each other by the predetermined gap, and a second spacing part to space apart second ends of the first and second shafts from each other by the predetermined gap.

3. The roller spacing apparatus as claimed in claim 1, wherein the stopping member comprises:

a first stopping protrusion to restrict a first directional movement of the lever; and a second stopping protrusion to restrict a second directional movement of the lever opposite to the first directional movement.

4. The roller spacing apparatus as claimed in claim 3, wherein the position holding protrusion is disposed between the first and the second stopping protrusions of the stopping member.

5. The roller spacing apparatus as claimed in claim 4, wherein the position holding protrusion is elastically movable by an external force applied to the position holding protrusion, or by the lever.

6. The roller spacing apparatus as claimed in claim 1, wherein the first roller member includes a photoconductive medium capable of having an electrostatic latent image formed thereon, and the second roller member includes a developing roller to develop the electrostatic latent image.

7. The roller spacing apparatus as claimed in claim 1, wherein the first roller member includes a photoconductive medium capable of having an electrostatic latent image formed thereon, and the second roller member includes a charging roller to charge the photoconductive medium with a predetermined electric potential.

8. The roller spacing apparatus as claimed in claim 1, wherein the first roller member includes a photoconductive medium capable of having an electrostatic latent image formed thereon, and the second roller member includes a transfer roller to transfer a developer image from the photoconductive medium to a print medium or to an intermediate transfer medium.

9. A developing roller spacing apparatus of an image forming device, the apparatus comprising:

a photoconductive medium capable of having an electrostatic latent image formed thereon, the photoconductive medium comprising a first shaft;

a developing roller that is rotatable in close contact with the photoconductive medium under a predetermined pressure to develop the electrostatic latent image, the developing roller comprising a second shaft; and at least one spacing part to space the photoconductive medium and the developing roller apart from each other by a predetermined gap such that the photoconductive medium and the developing roller are not in contact with each other when the photoconductive medium and the developing roller are not in use, wherein the spacing part comprises:

a bushing member that has a bushing to rotatably support at least one of the first and second shafts, and a lever disposed at the bushing to rotate the bushing, the bushing having an inner diameter part for supporting at least one of the first and second shafts and an outer diameter part, the inner and outer diameter parts being non-concentric circles such that a center point of the inner diameter part is at a different location from a center point of the outer diameter part;

a stopping member to restrict an operation range of the lever; and a position holding member to hold the lever such that the bushing is in a first position to bring the photoconductive medium and the developing roller into contact with each other or a second position to space the photoconductive medium and the developing roller apart from each other by the predetermined gap wherein the position holding member comprises a position holding protrusion, the position holding protrusion being elastically movable between a up-position, in which the position holding protrusion is located within a moving path of the lever, and a down-position, in which the position holding protrusion is located outside of the moving path of the lever.

10. A charging roller spacing apparatus of an image forming device, the apparatus comprising:

a photoconductive medium capable of having an electrostatic latent image formed thereon, the photoconductive medium comprising a first shaft;

a charging roller that is rotatable in close contact with the photoconductive medium under a predetermined pressure to charge the photoconductive medium with a predetermined electric potential to form the electrostatic latent image, the charging roller comprising a second shaft; and at least one spacing part to space the photoconductive medium and the charging roller apart from each other by a predetermined gap such that the photoconductive medium and the charging roller are not in contact with each other when the photoconductive medium and the charging roller are not in use, wherein the at least one spacing part comprises:

a bushing member that has a bushing to rotatably support at least one of the first and second shafts, and a lever positioned at the bushing to rotate the bushing, the bushing having an inner diameter part for supporting at least one of the first and second shafts, and an outer diameter part, the inner and outer diameter parts being non-concentric circles such that a center point of the inner diameter part is at a different location from a center point of the outer diameter part;

a stopping member to restrict an operation range of the lever; and a position holding member to hold the lever such that the bushing is in a first position to bring the photoconductive medium and the charging roller into contact with each other or a second position to space the photoconductive medium and the charging roller apart from each other by the predetermined gap.

wherein the position holding member comprises a position holding protrusion, the position holding protrusion being elastically movable between a up-position, in which the position holding protrusion is located within a moving path of the lever and a down-position, in which the position holding protrusion is located outside of the moving path of the lever.

11. An image forming device, comprising:

a body having a frame having a manipulation member located thereon; and a process cartridge comprising:

a first rotatable roller member comprising a first shaft;

a second rotatable roller member that is rotatable in close contact with the first roller member under a predetermined pressure, the second rotatable roller member comprising a second shaft;

at least one spacing part to space the first and the second roller members apart from each other by a predetermined gap such that the first and the second roller members are not in contact with each other when the first and the second roller members are not in use; and a housing to integrally modulate the first and the second members with the spacing part, the housing being detachably mounted in the frame, wherein the spacing part comprises a bushing member comprising at least one bushing and at least one lever operatable by an external force and the manipulation member to rotate the bushing, the bushing being rotatably disposed in the housing to rotatably support at least one of the first and second shafts, the bushing having an inner diameter part for supporting at least one of the first and second shafts and an outer diameter part, the inner and outer diameter parts being non-concentric circles such that a center point of the inner diameter part is at a different location from a center point of the outer diameter part wherein the spacing part further comprises a position holding member disposed at the housing to hold the lever such that the bushing is in a first position to bring the first and the second roller members into contact with each other or a second position to space the first and the second roller members apart from each other by the predetermined gap, wherein the position holding member comprises a position holding protrusion, the position holding protrusion being elastically movable by an external force or by the lever between an up-position, where the position holding protrusion is located within a moving path of the lever, and a down-position, where the position holding protrusion is located outside of the moving path of the lever.

12. The image forming device as claimed in claim 11, wherein the at least one spacing part comprises a first spacing part to space first end portions of the first and second shafts apart from each other by the predetermined gap, and a second spacing part to space second end portions of the first and second shafts apart from each other by the predetermined gap.

13. The image forming device as claimed in claim 11, wherein the housing comprises a fixing hole and the bushing member further comprises at least one hook member to lock the bushing onto one side edge of the fixing hole.

14. The image forming device as claimed in claim 11, wherein the spacing part further comprises a stopping member to restrict an operation range of the lever.

15. The image forming device as claimed in claim 14, wherein the stopping member comprises:

a first stopping protrusion to restrict a first directional movement of the lever; and a second stopping protrusion to restrict a second, opposite directional movement of the lever.

16. The image forming device as claimed in claim 15, wherein the position holding protrusion is disposed between the first and the second stopping protrusions of the stopping member.

17. The image forming device as claimed in claim 11, wherein the first roller member includes a photoconductive medium capable of having an electrostatic latent image formed thereon, and the second roller member includes a developing roller to develop the electrostatic latent image.

18. The image forming device as claimed in claim 11, wherein the first roller member includes a photoconductive medium capable of having an electrostatic latent image formed thereon, and the second roller member includes a charging roller to charge the photoconductive medium with a predetermined electric potential.

19. An image forming apparatus, comprising:

a housing;

a first roller rotatably mounted on the housing;

a second roller rotatably mounted on the housing; and a bushing member located between the housing and one of the first roller and the second roller, wherein the bushing member comprises a bushing that rotatably supports at least one of the first and second rollers and has an outer diameter part rotatably mounted on the housing and, the outer diameter having a first center, and an inner diameter part coupled to the one of the first roller and the second roller, the inner diameter part having a second center deviated from the first center; and a lever positioned at the bushing to rotate the bushing, wherein the apparatus further comprises, a position holding member to hold the lever such that the bushing is in a first position to bring the first and the second rollers into contact with each other or a second position to space the first and the second rollers apart from each other by the predetermined gap, wherein the position holding member comprises a position holding protrusion, the position holding protrusion being elastically movable between a up-position, in which the position holding protrusion is located within a moving path of the lever, and a down-position, in which the position holding protrusion is located outside of the moving path of the lever.

20. The image forming apparatus as claimed in claim 19, further comprising:

a third roller rotatably mounted on the housing; and a second bushing member located between the housing and the third roller, the second bushing member having a second outer diameter part rotatably mounted on the housing, the second outer diameter part having a third center, and a second inner diameter part coupled to the third roller, the second inner diameter part having a fourth center deviated from the third center.

21. The image forming apparatus as claimed in claim 19, wherein the second center of the inner diameter part moves between two different positions with respect to the first center of the outer diameter part.

22. The image forming apparatus as claimed in claim 21, wherein the one of the first roller and the second roller moves between a contact position and a non-contact position with respect to the other one of the first roller and the second roller according to a movement of the second center between the two different positions.

23. The image forming apparatus as claimed in claim 19, wherein the housing comprises a fixing hole to receive the bushing member and to correspond to the outer diameter part, and the one of the first roller and the second roller comprises a shaft to be inserted into the inner diameter part and having a shaft center corresponding to the second center.

24. The image forming apparatus as claimed in claim 23, wherein the first center, the second center, and the shaft center are located within the fixing hole.

* * * * *